US008690388B2

(12) United States Patent
Lu et al.

(10) Patent No.: US 8,690,388 B2
(45) Date of Patent: Apr. 8, 2014

(54) LIGHT EMITTING DIODE CUP LIGHT

(75) Inventors: Wen-Cheng Lu, Houlong Township, Miaoli County (TW); Chi-Cheng Cheng, Zhubei (TW)

(73) Assignee: Lextar Electronics Corporation, Hsinchu (TW)

( * ) Notice: Subject to any disclaimer, the term of this patent is extended or adjusted under 35 U.S.C. 154(b) by 78 days.

(21) Appl. No.: 13/446,213

(22) Filed: Apr. 13, 2012

(65) Prior Publication Data

US 2012/0262932 A1 Oct. 18, 2012

(30) Foreign Application Priority Data

Apr. 15, 2011 (TW) ..... 100113251 A

(51) Int. Cl.
*F21V 33/00* (2006.01)

(52) U.S. Cl.
USPC ..... 362/249.02; 362/800

(58) Field of Classification Search
USPC ..... 362/249.02, 800
See application file for complete search history.

(56) References Cited

U.S. PATENT DOCUMENTS

| | | | |
|---|---|---|---|
| 5,936,263 | A | 8/1999 | Hashizume |
| 6,787,999 | B2 | 9/2004 | Stimac et al. |
| 6,947,620 | B2 | 9/2005 | Florin |
| 7,118,262 | B2 | 10/2006 | Negley |
| 7,138,667 | B2 | 11/2006 | Barnett et al. |
| 7,275,841 | B2 | 10/2007 | Kelly |
| 7,712,922 | B2 | 5/2010 | Hacker et al. |
| 7,717,589 | B2 | 5/2010 | Nishioka et al. |
| 7,922,366 | B2 | 4/2011 | Li |
| 8,017,964 | B2 | 9/2011 | Lin et al. |
| 8,033,687 | B2 | 10/2011 | Wang |
| 8,083,380 | B2 | 12/2011 | Zhou |
| 8,083,381 | B2 | 12/2011 | Tsai |
| 8,092,052 | B2 | 1/2012 | Lee |
| 8,115,385 | B2 | 2/2012 | Norfidathul et al. |
| 8,157,422 | B2 | 4/2012 | Paik et al. |
| 8,167,463 | B2 | 5/2012 | Loh |
| 8,174,038 | B2 | 5/2012 | Hoshina |
| 8,182,110 | B2 | 5/2012 | Jiang et al. |

(Continued)

FOREIGN PATENT DOCUMENTS

| | | | |
|---|---|---|---|
| CN | 101210664 | A | 7/2008 |
| JP | 2007213943 | A | 8/2007 |

(Continued)

OTHER PUBLICATIONS

English Abstract translation of JP2010060728 (Published Mar. 18, 2010).

(Continued)

*Primary Examiner* — Laura Tso
(74) *Attorney, Agent, or Firm* — McClure, Qualey & Rodack, LLP

(57) ABSTRACT

A light emitting diode (LED) cup light includes a base, a substrate, a LED light source and a fixing structure. The base includes a frame and a carrying member. The frame is surroundingly coupled to a periphery of the carrying member. The carrying member has a through hole. The substrate is disposed on the carrying member of the base. The LED light source is disposed on the substrate. The fixing structure presses on substrate and is engaged with a bottom surface of the carrying member of the base through the through hole.

11 Claims, 4 Drawing Sheets

(56) References Cited

U.S. PATENT DOCUMENTS

| | | | | |
|---|---|---|---|---|
| 8,263,992 | B2 | 9/2012 | Chen et al. | |
| 8,324,645 | B2 | 12/2012 | Liu et al. | |
| 8,324,789 | B2 | 12/2012 | Hisayasu et al. | |
| 8,376,562 | B2 | 2/2013 | Osawa et al. | |
| 8,376,580 | B2 | 2/2013 | Li | |
| 8,425,070 | B2 * | 4/2013 | Shin | 362/97.3 |
| 8,434,910 | B2 | 5/2013 | Kim | |
| 8,445,824 | B2 | 5/2013 | Negley et al. | |
| 2002/0024818 | A1 | 2/2002 | Kondo et al. | |
| 2005/0001230 | A1 | 1/2005 | Takekuma | |
| 2007/0001185 | A1 | 1/2007 | Lu et al. | |
| 2008/0087911 | A1 | 4/2008 | Stoyan | |
| 2008/0158887 | A1 * | 7/2008 | Zhu et al. | 362/294 |
| 2009/0189169 | A1 | 7/2009 | Wei | |
| 2009/0224277 | A1 | 9/2009 | Leung et al. | |
| 2009/0237932 | A1 * | 9/2009 | Lee | 362/249.02 |
| 2009/0242919 | A1 | 10/2009 | Lin et al. | |
| 2009/0250717 | A1 | 10/2009 | Lin et al. | |
| 2009/0302343 | A1 | 12/2009 | Sato et al. | |
| 2010/0006877 | A1 | 1/2010 | Chen | |
| 2010/0027270 | A1 | 2/2010 | Huang et al. | |
| 2010/0157596 | A1 * | 6/2010 | Wen et al. | 362/235 |
| 2010/0165635 | A1 | 7/2010 | Chen et al. | |
| 2010/0165636 | A1 | 7/2010 | Chen et al. | |
| 2010/0172140 | A1 | 7/2010 | Chen et al. | |
| 2010/0230695 | A1 | 9/2010 | Lan et al. | |
| 2010/0327302 | A1 | 12/2010 | Wang et al. | |
| 2011/0084295 | A1 | 4/2011 | Matsuura et al. | |
| 2011/0089453 | A1 | 4/2011 | Min | |
| 2011/0089837 | A1 * | 4/2011 | Ho | 315/113 |
| 2011/0096553 | A1 | 4/2011 | Shimokawa | |
| 2011/0122632 | A1 | 5/2011 | Ku et al. | |
| 2011/0127546 | A1 | 6/2011 | Jaus et al. | |
| 2011/0127553 | A1 | 6/2011 | Duan et al. | |
| 2011/0194289 | A1 | 8/2011 | Dong | |
| 2011/0233593 | A1 | 9/2011 | Kawagoe et al. | |
| 2012/0002424 | A1 | 1/2012 | Cho et al. | |
| 2012/0020086 | A1 * | 1/2012 | Kataoka | 362/249.02 |
| 2012/0037934 | A1 | 2/2012 | Lee | |
| 2012/0106163 | A1 | 5/2012 | Liang et al. | |
| 2012/0127728 | A1 | 5/2012 | Chang | |
| 2012/0138998 | A1 | 6/2012 | Itou et al. | |
| 2012/0161186 | A1 | 6/2012 | Katabe et al. | |
| 2012/0175655 | A1 | 7/2012 | Cheng et al. | |
| 2013/0026922 | A1 | 1/2013 | Allen et al. | |
| 2013/0033876 | A1 | 2/2013 | Venturini | |
| 2013/0049049 | A1 | 2/2013 | Choi | |
| 2013/0075776 | A1 | 3/2013 | Murai et al. | |
| 2013/0088877 | A1 | 4/2013 | Hsu et al. | |

FOREIGN PATENT DOCUMENTS

| | | | |
|---|---|---|---|
| JP | 2010003674 | A | 1/2010 |
| JP | 201060728 | | 3/2010 |
| TW | 200827617 | | 7/2008 |
| TW | I322869 | | 6/2009 |
| WO | 2010004702 | A1 | 1/2010 |
| WO | 2011039998 | A1 | 7/2011 |

OTHER PUBLICATIONS

JP Office Action dated May 14, 2013.
English Abstract translation of CN101210664 (Published Jul. 2, 2008).
TW Office Action dated Mar. 19, 2013.
TW Office Action dated Jun. 21, 2013.
JP Office Action dated Jul. 30, 2013.
English Abstract translation of JP2007213943 (Published Aug. 23, 2007).
English Abstract translation of JP20103674 (Published Jan. 7, 2010).

* cited by examiner

LIGHT EMITTING DIODE CUP LIGHT

This application claims the benefit of Taiwan application Serial No. 100113251, filed Apr. 15, 2011, the subject matter of which is incorporated herein by reference.

BACKGROUND OF THE INVENTION

1. Field of the Invention

The invention relates in general to a cup light, and more particularly to a light emitting diode (LED) cup light.

2. Description of the Related Art

Generally speaking, a LED light advantageously has the high light emitting efficiency, the long lifetime, the low power consumption and the low contamination. Thus, with the rising awareness of environmental protection, the applications of the LED lights are quite common and popular. Further descriptions will be made with respect to the structure and arrangement of the LED light. Each of most LED lights includes a metallic base and a LED light source module usually fixed to the metallic base by screws.

However, once the Hi-Pot test is performed, the screws that are very close to the LED light source module may couple the voltage, applied to the LED light source module, to the metallic base. That is, when the LED light is actually used, the LED light tends to cause the short circuited condition, and the user may be dangerously shocked.

In addition, when the screws are used to fix the LED light source module to the metallic base, the assembling time and cost of the LED light source module may be relatively increased. Thus, it is an important subject of this industry to provide a LED light capable of preventing the failure of the Hi-Pot test from being caused by screws and decreasing the assembling time and cost.

SUMMARY OF THE INVENTION

The invention is directed to a light emitting diode (LED) cup light, in which a substrate and a LED light source are fixed with a fixing structure being engaged with a base so that the failure of the Hi-Pot test caused by the screws is avoided, and the assembling time and cost can be effectively decreased.

According to the present invention, a light emitting diode (LED) cup light is provided. The LED cup light includes a base, a substrate, a LED light source and a fixing structure. The base includes a frame and a carrying member. The frame is surroundingly coupled to a periphery of the carrying member. The carrying member has a through hole. The substrate is disposed on the carrying member of the base. The LED light source is disposed on the substrate. The fixing structure presses on the substrate and is engaged with a bottom surface of the carrying member of the base through the through hole.

The above and other aspects of the invention will become better understood with regard to the following detailed description of the preferred but non-limiting embodiment(s). The following description is made with reference to the accompanying drawings.

DETAILED DESCRIPTION OF THE INVENTION

Figure 1A:
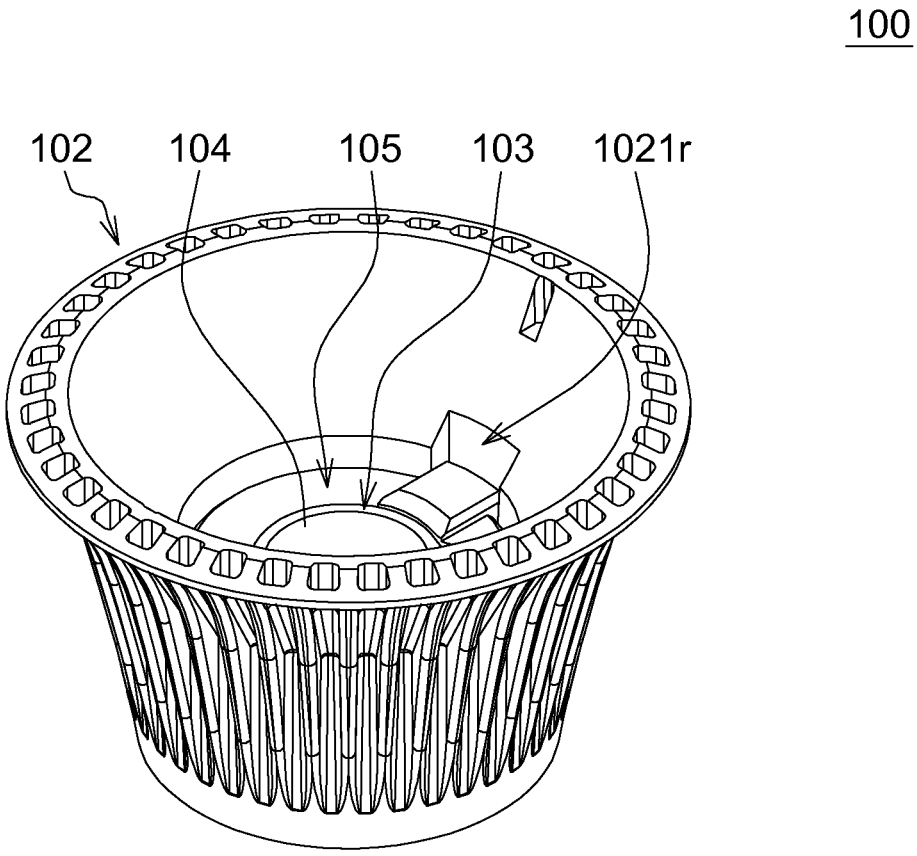
FIGS. 1A and 1B are an assembled view and an exploded view showing a LED cup light according to an embodiment of the invention, respectively.
Figure 1B:
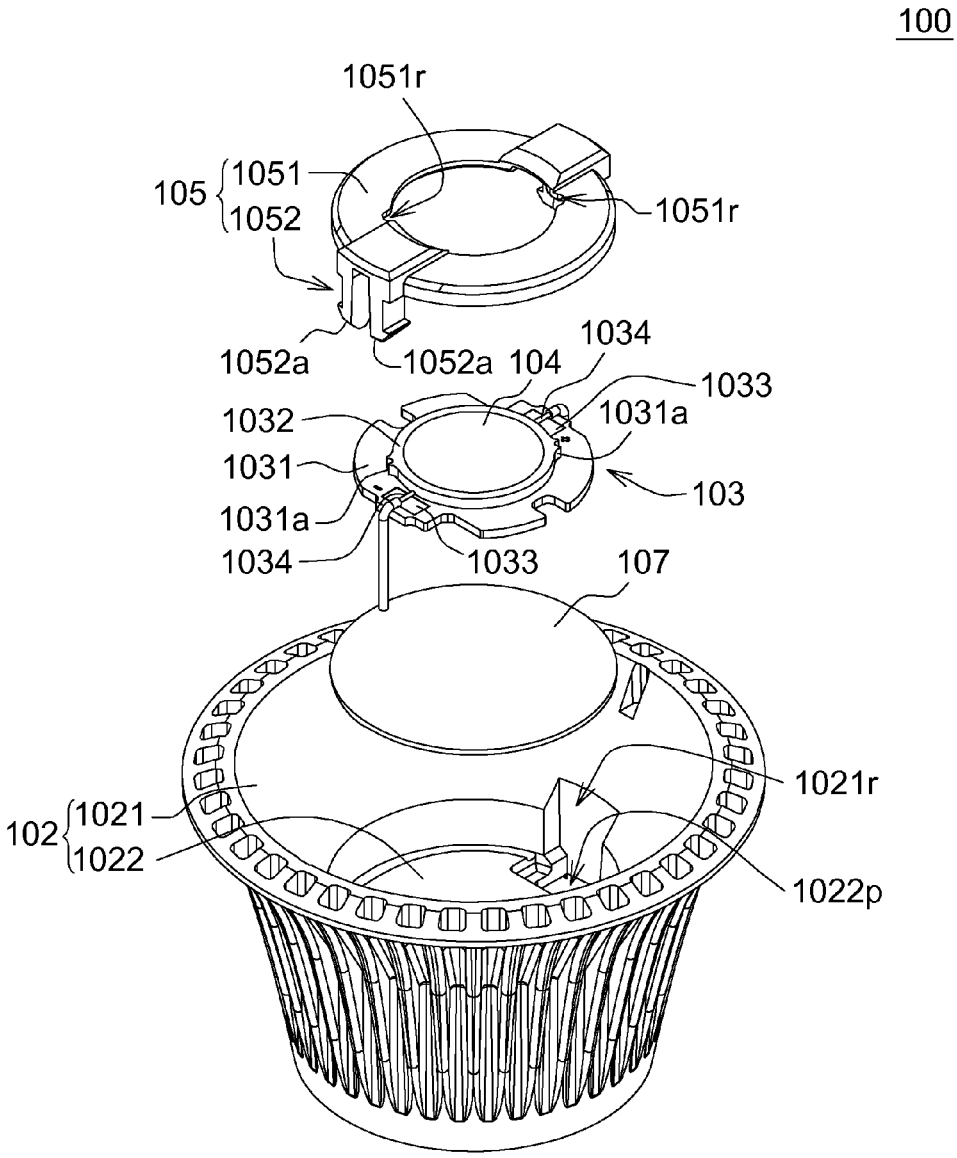
Figure 2:
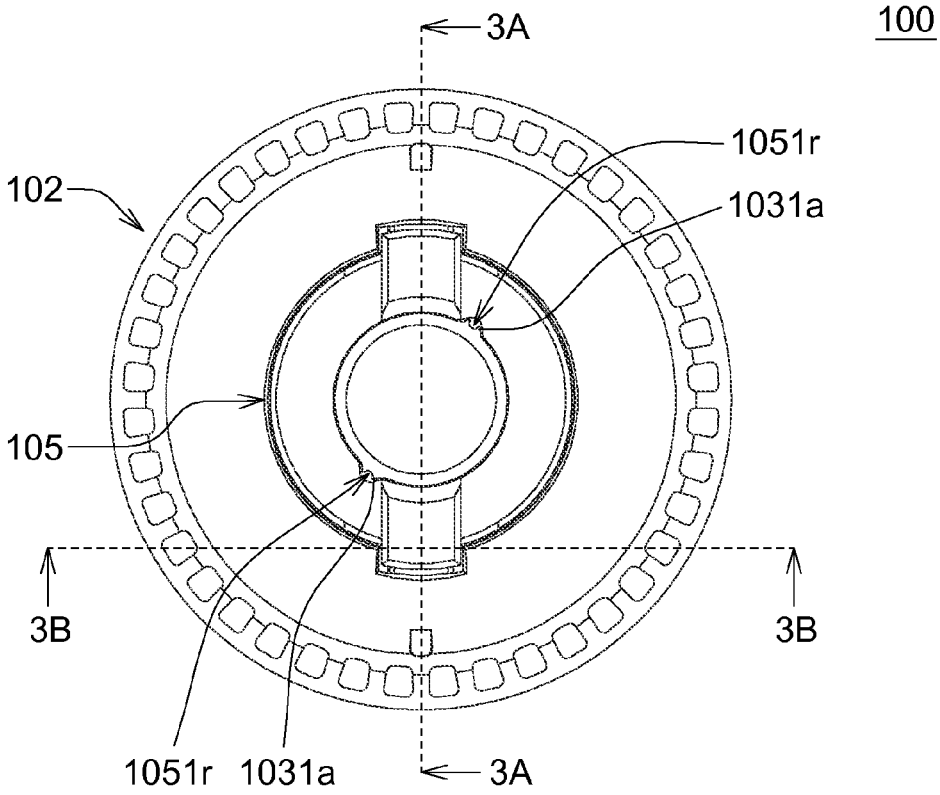
FIG. 2 is a top view showing the LED cup light of FIG. 1A.
Figure 3A:
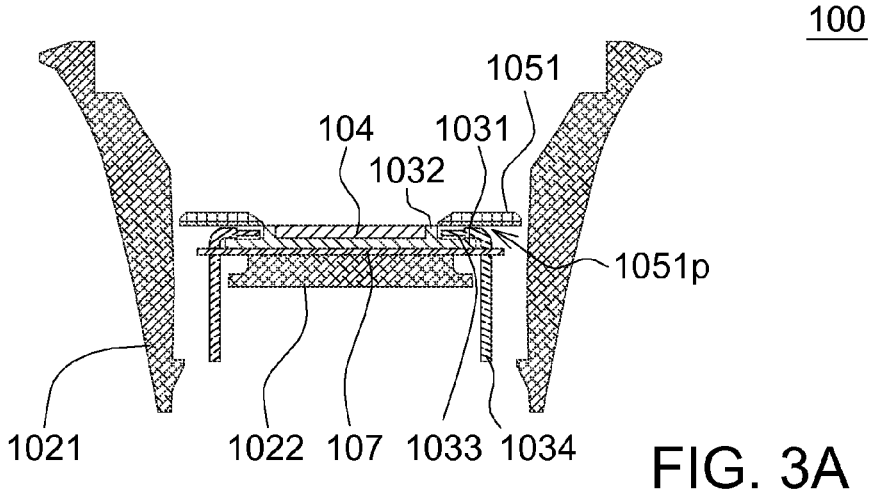
FIGS. 3A and 3B are cross-sectional views taken along cross-sectional lines 3A-3A and 3B-3B of the LED cup light of FIG. 2, respectively.
Figure 3B:
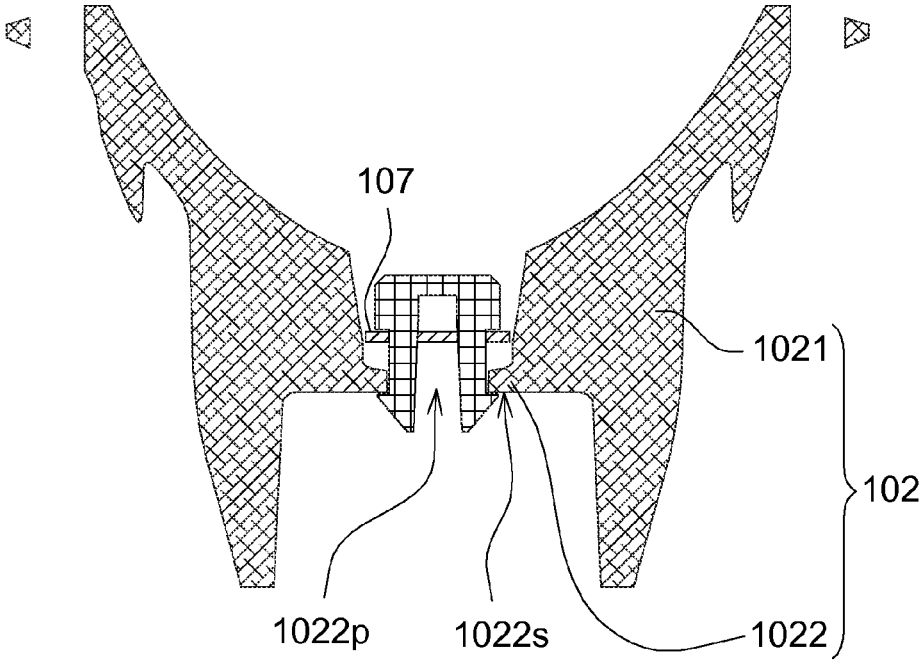
Figure 4:
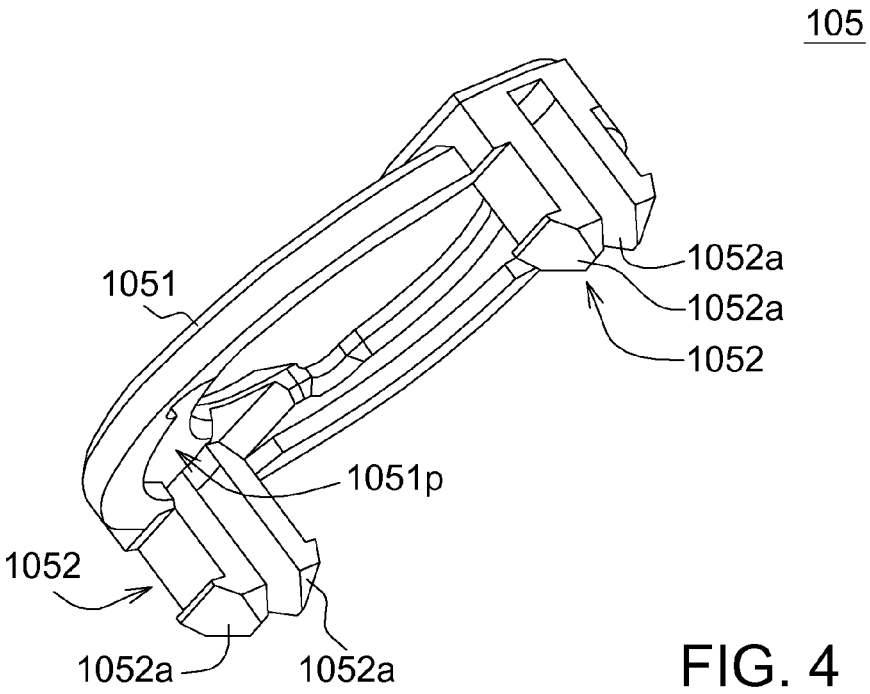
FIG. 4 is a schematic view showing a fixing structure of FIG. 1A.

Please refer to FIGS. 1A, 1B, 2, 3A, 3B and 4. FIGS. 1A and 1B are an assembled view and an exploded view showing a LED cup light according to an embodiment of the invention, respectively. FIG. 2 is a top view showing the LED cup light of FIG. 1A. FIGS. 3A and 3B are cross-sectional views taken along cross-sectional lines 3A-3A and 3B-3B of the LED cup light of FIG. 2, respectively. FIG. 4 is a pictorial view showing a fixing structure of FIG. 1A.

As shown in FIG. 1A, a LED cup light 100 includes a base 102, a substrate 103, a LED light source 104 and a fixing structure 105.

As shown in FIGS. 1B, 2, 3A and 3B, the base 102 includes a frame 1021 and a carrying member 1022. The frame 1021 is surroundingly coupled to a periphery of the carrying member 1022. The carrying member 1022 has a through hole 1022*p*. The substrate 103 is disposed on the carrying member 1022 of the base 102. The LED light source 104 is disposed on the substrate 103. The fixing structure 105 presses on the substrate 103 and is engaged with a bottom surface 1022*s* of the carrying member 1022 of the base 102 through the through hole 1022*p* (see FIG. 3B).

In this embodiment, the fixing structure 105 includes a pressing plate 1051 and a hook 1052. The pressing plate 1051 presses on the substrate 103. The hook 1052 is coupled to the pressing plate 1051, extends through the through hole 1022*p* from the pressing plate 1051 and is engaged with the bottom surface 1022*s* of the carrying member 1022 (see FIG. 3B). The frame 1021 of this embodiment has an accommodating slot 1021*r*, which communicates with the through hole 1022*p* and accommodates the hook 1052.

The configuration relationship between the fixing structure 105 and the substrate 103 will be further described in the following. The substrate 103 includes a first plate member 1031 and a second plate member 1032. The first plate member 1031 is disposed on the carrying member 1022 of the base 102. The second plate member 1032 is disposed on the first plate member 1031. The LED light source 104 is embedded into the second plate member 1032. The pressing plate 1051 presses on the first plate member 1031 and surrounds a periphery of the second plate member 1032. That is, the pressing plate 1051 is a central hollow ring structure so that the second plate member 1032 is exposed from a central opening of the pressing plate 1051 while pressing on the first plate member 1031. Consequently, the light source generated by the LED light source 104 is not shielded by the fixing structure 105. Thus, the fixing structure 105 can firmly fix the substrate 103 and the LED light source 104 under the precondition of maintaining the light utilization of the LED light source 104.

As shown in FIGS. 1B and 2, in order to position the fixing structure 105 on the substrate 103 so that the fixing structure 105 cannot be arbitrarily rotated, an outer sidewall of the second plate member 1032 of this embodiment has a salient 1031*a*, and an inner sidewall of the pressing plate 1051 has a notch 1051*r*. The salient 1031*a* is accommodated within the notch 1051*r* to avoid the relative rotation between the fixing structure 105 and the substrate 103.

As shown in FIGS. 1B, 3A and 4, in order to supply the power to the LED light source 104, the substrate 103 in this embodiment further includes two electrical pads 1033 and two wires 1034. The two electrical pads 1033 are, for example, a positive electrode pad and a negative electrode pad. The two electrical pads 1033 are disposed on the first plate member 1031 and electrically connected to the LED light source 104. One end of each wire 1034 is connected to the corresponding electrical pad 1033. Because the end of each wire 1034 is connected to the corresponding electrical pad 1033 by way of soldering, for example, the cured solder may project beyond the electrical pad 1033. In order to make the pressing plate 1051 directly press on the first plate member 1031, the bottom surface of the pressing plate 1051 of this embodiment has two recesses 1051*p*, wherein the positions of the two recesses 1051*p* respectively correspond to the positions of the two electrical pads 1033. Consequently, the end of each wire 1034 is located in the corresponding recess 1051*p*, such that a large portion of the bottom surface of the pressing plate 1051 can press on the first plate member 1031 to achieve the firmly fixing effect.

As shown in FIGS. 1B and 4, the fixing structure 105 of this embodiment includes four hooks 1052 classified into two pairs each having two neighboring hooks 1052. The neighboring two hooks 1052 have hooking bodies 1052*a* facing opposite directions. Consequently, both the stability and the structural strength of the fixing structure 105 can be satisfied. Although this embodiment illustrates four hooks 1052 disposed on the periphery of the pressing plate 1051, wherein the hooking bodies 1052*a* of the two neighboring hooks 1052 face the opposite directions, those skilled in the art should understand that the positions and the number of the hooks 1052 as well as the directions of the hooking bodies 1052*a* of the hooks 1052 are not limited to this embodiment.

As shown in FIGS. 1B, 3A and 3B, the LED cup light 100 further includes a thermoconductive insulating layer 107 disposed between the substrate 103 and the carrying member 1022 of the base 102. The thermoconductive insulating layer 107 may serve as a heat transfer medium for transferring the heat, generated by the LED light source 104, to the base 102 so that the heat can be dissipated. In addition, according to the general safety project, the electric power of the LED light source 104 is prohibited from transferring to the base 102 to prevent the operator from being hurt by the electric power. Thus, the thermoconductive insulating layer 107 of this embodiment is made of an insulation material to satisfy the safety project.

In this embodiment, the base 102 may be made of, for example, a metallic, plastic or composite material, and the fixing structure 105 may be made of, for example, a metallic, plastic or composite material. In most of the conventional LED light source modules, screws are utilized to fix the LED light source module to the metallic base, and the screws that are very close to the LED light source module tend to couple the voltage, applied to the LED light source module in the Hi-Pot test, to the metallic base. Consequently, the short circuited condition may be caused, and the user may be dangerously shocked. In this embodiment, the base 102 is made of the metallic material, and the fixing structure 105 is made of the plastic material. Because the fixing structure 105 is made of the plastic material and can fix the substrate 103 and the LED light source 104, this embodiment is safer than the prior art using screws for screwing and can pass the Hi-Pot test.

According to the LED cup light of the embodiment of the invention, the fixing structure is utilized to fix the substrate and the LED light source by way of engaging. Consequently, it is possible to avoid the failure of the Hi-Pot test caused by the conventional screws, and the assembling time and cost may also be saved.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A light emitting diode (LED) cup light, comprising:

a base comprising a frame and a carrying member, wherein the frame is surroundingly coupled to a periphery of the carrying member, and the carrying member has a through hole;

a substrate disposed on the carrying member of the base, the substrate comprising a first plate member and a second plate member disposed on the first plate member;

a LED light source disposed on the first plate member, wherein the second plate member surrounds a periphery of the LED light source; and a fixing structure, which presses on the substrate and is engaged with a bottom surface of the carrying member of the base through the through hole.

2. The LED cup light according to claim 1, wherein the fixing structure comprises:

a pressing plate pressing on the substrate; and a hook, which is coupled to the pressing plate, extends through the through hole from the pressing plate, and is engaged with the bottom surface of the carrying member.

3. The LED cup light according to claim 2, wherein:

the first plate member disposed on the carrying member of the base, and the pressing plate presses on the first plate member and surrounds a periphery of the second plate member.

4. The LED cup light according to claim 3, wherein an outer sidewall of the second plate member has a salient, an inner sidewall of the pressing plate has a notch, and the salient is accommodated within the notch.

5. The LED cup light according to claim 3, wherein a bottom surface of the pressing plate has a recess, and the substrate comprises:

an electrical pad disposed on the first plate member at a position corresponding to a position of the recess; and a wire having one end, which is connected to the electrical pad and disposed in the recess.

6. The LED cup light according to claim 2, wherein the frame has an accommodating slot, which communicates with the through hole and accommodates the hook.

7. The LED cup light according to claim 2, wherein the fixing structure comprises two hooks.

8. The LED cup light according to claim 7, wherein hooking bodies of the two hooks face opposite directions.

9. The LED cup light according to claim 1, wherein the base is made of a metallic, plastic or composite material.

10. The LED cup light according to claim 1, wherein the fixing structure is made of a metallic, plastic or composite material.

11. The LED cup light according to claim 1, further comprising:

a thermoconductive insulating layer disposed between the substrate and the carrying member of the base.

* * * * *